US009877093B2

(12) United States Patent
Wang et al.

(10) Patent No.: US 9,877,093 B2
(45) Date of Patent: Jan. 23, 2018

(54) SOUND GENERATOR

(71) Applicants: Chengliang Wang, Shenzhen (CN); Fuhu Zhang, Shenzhen (CN)

(72) Inventors: Chengliang Wang, Shenzhen (CN); Fuhu Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 14/827,655

(22) Filed: Aug. 17, 2015

(65) Prior Publication Data

US 2016/0198248 A1 Jul. 7, 2016

(30) Foreign Application Priority Data

Jan. 6, 2015 (CN) ..... 2015 2 0007341 U

(51) Int. Cl.
*H04R 25/00* (2006.01)
*H04R 1/02* (2006.01)
*H04R 31/00* (2006.01)

(52) U.S. Cl.
CPC ..... *H04R 1/02* (2013.01); *H04R 1/021* (2013.01); *H04R 31/006* (2013.01); *H04R 2499/11* (2013.01)

(58) Field of Classification Search
CPC .... H04M 1/0274; H04M 1/026; H05K 1/182; H05K 2201/10083; H04R 7/02; H04R 1/14; H04R 7/18; H04R 1/021; H04R 12/00; H04R 1/02; H04R 1/06
USPC ..... 381/380, 403, 150, 394–396, 409–410, 381/433; 439/79, 441, 345; 455/566, 455/569.1; 361/749
See application file for complete search history.

(56) References Cited

U.S. PATENT DOCUMENTS 4,915,647 A * 4/1990 Edgley ..... H01R 4/4818 29/741
5,239,589 A * 8/1993 Yang ..... H04R 1/06 381/394
5,588,066 A * 12/1996 Yang ..... H04R 1/026 381/386
6,385,328 B1 * 5/2002 Yoo ..... H04R 1/06 381/409
6,389,148 B1 * 5/2002 Yoo ..... H04R 11/02 381/417
7,369,674 B2 * 5/2008 Miura ..... H04R 9/10 381/396
7,458,826 B1 * 12/2008 Maatta ..... H01R 4/4809 439/79

(Continued)

FOREIGN PATENT DOCUMENTS

GB 2441369 A * 3/2008 ..... H04R 1/025

*Primary Examiner* — Davetta W Goins
*Assistant Examiner* — Phylesha Dabney
(74) *Attorney, Agent, or Firm* — Na Xu; IPro, PLLC

(57) ABSTRACT

A linear vibrator includes a stator having a housing including a receiving space therein, a moveable unit, an elastic member suspending the moveable unit in the receiving space, and a protection member located between the stator and the moveable unit. The protection member forms a first bevel along a vibration direction of the moveable unit, one of the stator and the moveable unit includes a second bevel corresponding to the first bevel. The second bevel keeps a distance from the first bevel for rubbing each other when the linear vibrator falls.

8 Claims, 3 Drawing Sheets

(56) References Cited

U.S. PATENT DOCUMENTS

| | | | | |
|---|---|---|---|---|
| 8,300,876 | B2 * | 10/2012 | Xu | H04R 1/06 381/150 |
| 8,989,428 | B2 * | 3/2015 | Hill | H04R 1/06 381/386 |
| 9,307,306 | B2 * | 4/2016 | Li | H04R 1/00 |
| 2014/0029783 | A1 * | 1/2014 | Yang | H04R 1/02 381/395 |
| 2016/0227007 | A1 * | 8/2016 | Wang | H04M 1/03 |

* cited by examiner

SOUND GENERATOR

FIELD OF THE INVENTION

The present invention relates to electroacoustic apparatuses, more particularly to a sound generator used in an electronic device for converting electrical signals to audible sounds.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of sound generators have been developed. A sound generator is generally coupled to an audio equipment or an amplifier for use as a large sound producing means for considerably amplifying volume. Alternatively, the sound generator may be used as a small sound producing means having a small size and volume.

An electronic device, such as a cellular phone, a camcorder, a PDA, a digital camera, or a notebook computer, provides a space for accommodating a sound generator therein. Nowadays, a sound generator with high quality audio performance and miniature size is desired.

Referring to FIG. 1, a sound generator related to the present disclosure includes a housing, a speaker unit 2' accommodated in the housing, and a contact 3' for electrically connecting the speaker unit to an external circuit. The contact 3' includes a positioning portion 31' connected to the speaker unit 2' and an extending portion 32' extending out of the housing. The positioning portion is positioned to a bottom of the speaker unit 2' and electrically connected to the speaker unit 2' via an elastic beam 33'. This configuration occupies greater space and limits the sound volume in the speaker unit, which badly affects the acoustic performance of the sound generator.

Accordingly, an improved sound generator enabling solving the problems mentioned above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
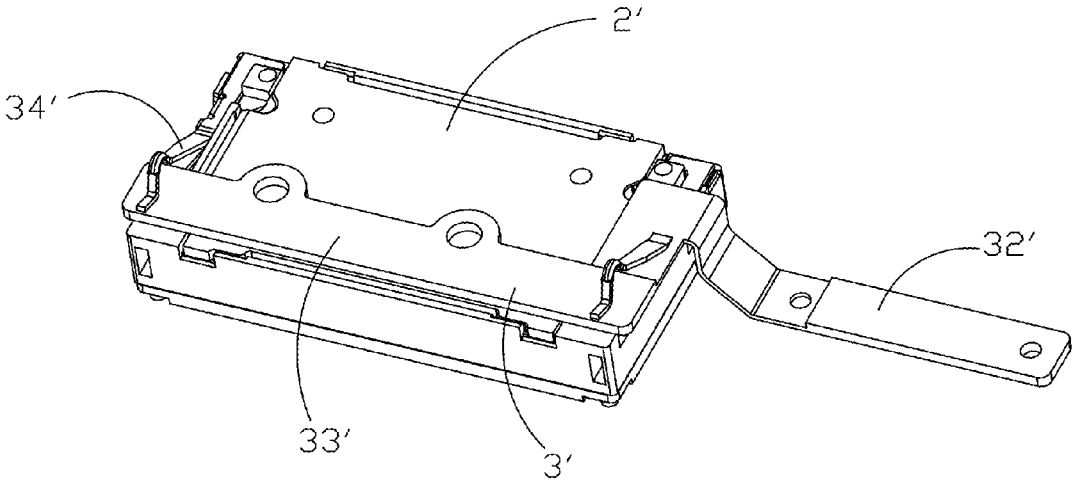
Fig. 1 (Prior Art)
FIG. 1 is an illustration of a sound generator related to the present disclosure.
Figure 2:
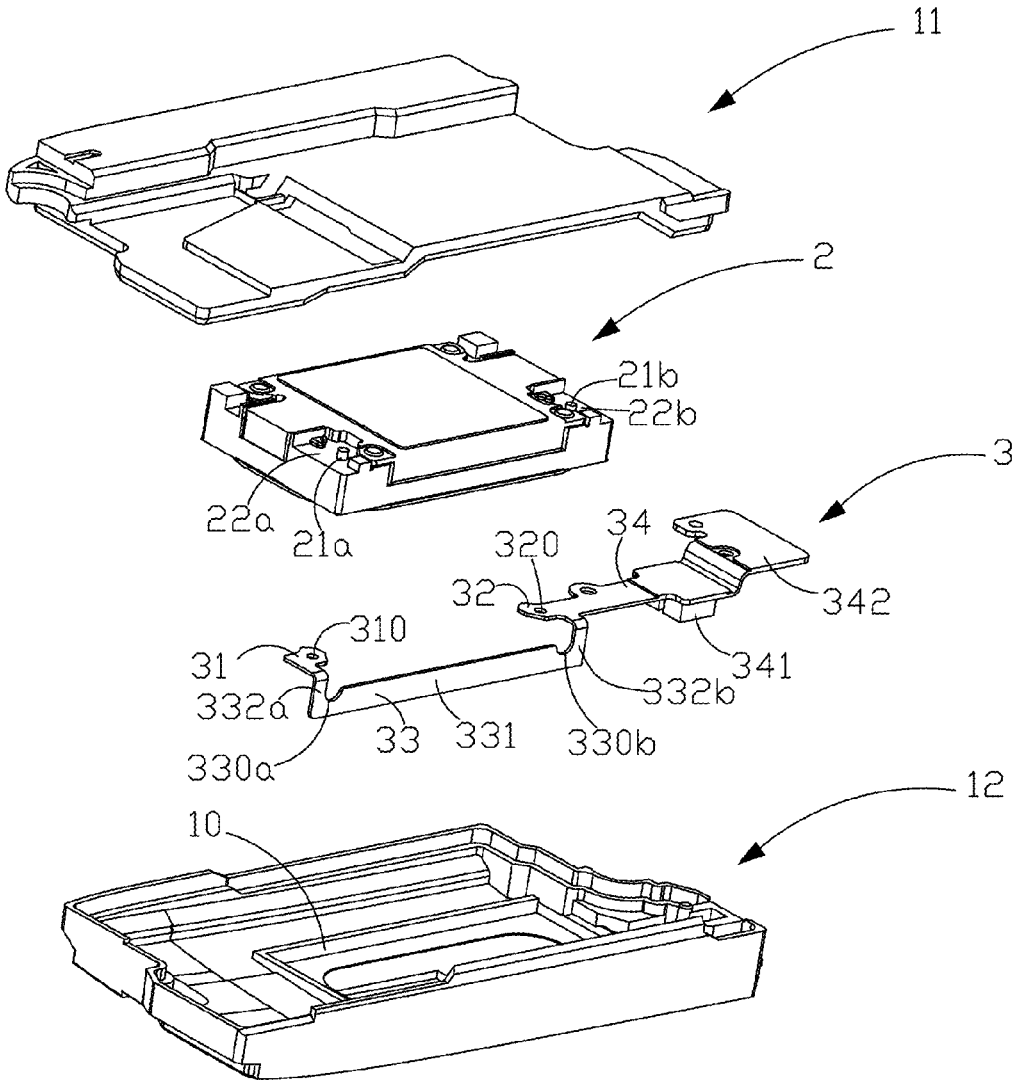
FIG. 2 is an isometric and exploded view of a sound generator in accordance with an exemplary embodiment of the present disclosure.
Figure 3:
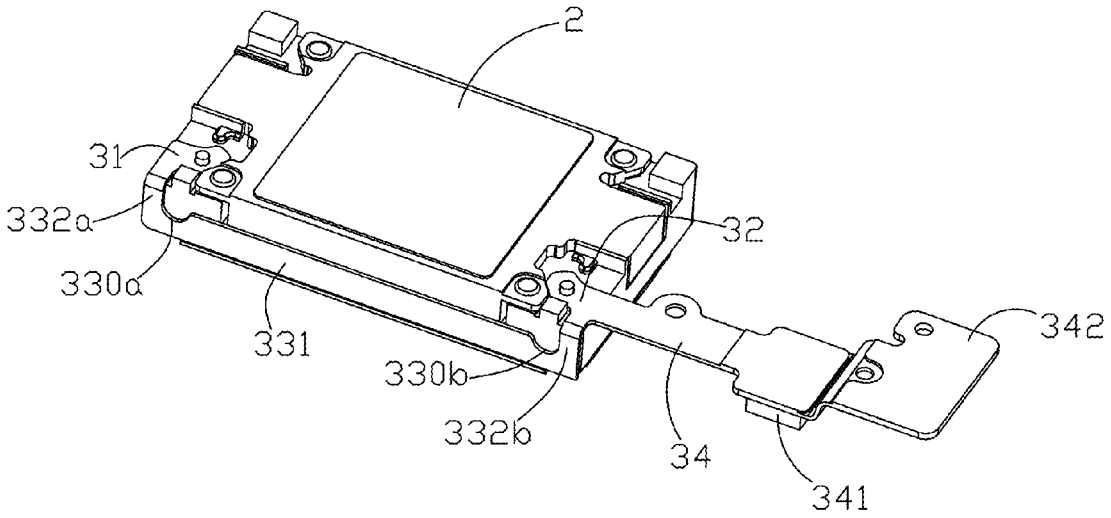
FIG. 3 is an assembled view of a speaker unit and a conductive terminal of the sound generator in FIG. 2.

Referring to FIGS. 2-3, a sound generator in accordance with an exemplary embodiment of the present disclosure is used in a portable consumer electronic device for producing audible sounds. The sound generator includes a housing 1 having a receiving space 10, a speaker unit 2 accommodated in the receiving space 10, and a conductive terminal for electrically connecting the speaker unit 2 to an external circuit.

The housing 1 includes an upper cover 12 and a lower cover 11 engaging with the upper cover 12 for forming the receiving space. The sound generator generally includes a magnetic circuit unit and a vibration unit. The vibration unit includes a diaphragm and a voice coil driving the diaphragm. Normally, the voice coil includes a pair of lead wires.

The conductive terminal includes a first pad 31, a second pad 32, and a connecting beam 33 connecting the first pad 31 to the second pad 32. The first and second pads 31, 32 are located a t a bottom of the speaker unit 2. The conductive terminal further includes an extending portion 34 extending from the second pad 32 along a direction far away from the speaker unit 2. The first and second pads 31, 32 are used for electrically connecting the speaker unit 2 to the external circuit. The first pad 31 forms a first through hole 310, and the second pad 32 forms a second through hole 320. Correspondingly, the bottom of the speaker unit 2 is provided with a first post 21*a* for engaging with the first through hole 310, and a second post 21*b* engaging with the second through hole 320. By virtue of the engagements between the first through hole 310 and the first post 21*a*, and between the second through hole 320 and the second post 21*b*, the conductive terminal is fixed on the bottom of the speaker unit 2. In this embodiment, the first and second posts 21*a*, 21*b* are formed by conductive material and extending into the inside of the speaker unit 2 for electrically connecting to the voice coil. Thus, the speaker unit is electrically connected to the conductive terminal. The engagements of the through holes in the conductive terminal and the posts on the speaker unit achieve the positioning function and the conductive connection as well.

The connecting beam 33 extends from edges of the first and second pads 31, 32 and is fixed on a side of the speaker unit which is perpendicular to the bottom of the speaker unit. The connecting beam 33 further includes a main body 331, a first transition portion 332*a* connecting one end of main body 331 to the first pad 31, and a second transition portion 332*b* connecting the other end of the main body 331 to the second pad 32. Thus, the connecting main body 331 is perpendicular to the first and second pads, and is connected to the first and second pads via the first transition portion 332*a* and the second transition portion 332*b*. In addition, a joint of the first transition portion 332*a* and the main body 331 forms a first recess 330*a*, and a joint of the second transition portion 332*b* and the main body 331 forms a second recess 330*b*, which reduces the stress concentration of the conductive terminal.

The extending portion 34 includes a contacting member 341, and a positioning portion 342 at a distal end thereof.

Optionally, the speaker unit 2 further includes a first step 22*a* and a second step 22*b* both recessed from the bottom thereof. The first post 21*a* is fixed on the first step 22*a*, and the second post 21*b* is fixed on the second step 22*b*. Correspondingly, the first pad 31 is positioned on the first step 22*a* by engagement between the first post 21*a* and the first through hole 310, and the second pad 32 is positioned on the second step 22*b* by engagement between the second post 21*b* and the second through hole 320. By virtue of the configuration mentioned above, a height of the sound generator is accordingly reduced. In addition, the sound generator can be assembled with external circuit easier, and can provide stable performance. Further, the conductive terminal does not occupy extra space of the sound generator, which provides a enlarged acoustic volume.

In this embodiment, the conductive terminal is a flexible printed circuit (FPC), and may also be other conductive component.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sound generator, comprising:

a housing having a receiving space therein;

a speaker unit accommodated in the receiving space, the speaker unit comprising a bottom, a top opposite to the bottom, and a side connected between the top and the bottom and further perpendicular to the bottom;

a conductive terminal assembled with the speaker unit for electrically connecting the speaker unit to an external circuit, the conductive terminal comprising a first pad and a second pad both mounted on the bottom of the speaker unit, a connecting beam mounted on attached onto the side of the speaker unit for electrically connecting the first pad and the second pad; the connecting beam including a main body perpendicular to the first pad and the second pad, a first transition portion connecting one end of the main body to the first pad, and a second transition portion connecting another end of the main body to the second pad.

2. The sound generator as described in claim 1, wherein the conductive terminal further comprises an extending portion extending from the second pad along a direction far away from the speaker unit.

3. The sound generator as described in claim 1, wherein a joint of the first transition portion and the main body forms a first recess, and a joint of the second transition portion and the main body forms a second recess for reducing stress concentration.

4. The sound generator as described in claim 1, wherein the first pad comprises a first through hole, and the bottom of the speaker unit comprises a first post for engaging with the first through hole.

5. The sound generator as described in claim 4, wherein the bottom of the speaker unit comprises a first step, and the first post is positioned on the first step.

6. The sound generator as described in claim 1, wherein the second pad comprises a second through hole, and the bottom of the speaker unit comprises a second post for engaging with the second through hole.

7. The sound generator as described in claim 6, wherein the bottom of the speaker unit comprises a second step, and the second post is positioned on the second step.

8. The sound generator as described in claim 2, wherein the extending portion includes a contacting member, and a positioning portion disposed at a distal end thereof.

* * * * *